US005953762A

United States Patent [19]

Corbett

[11] Patent Number: 5,953,762

[45] Date of Patent: Sep. 21, 1999

[54] SPORTS HELMET WITH PROTECTIVE FINCAP

[76] Inventor: Joseph Corbett, 422 Vt. Rte. 3, Pittsford, Vt. 05763

[21] Appl. No.: 09/249,983

[22] Filed: Feb. 11, 1999

[51] Int. Cl.[6] ..... A42B 3/04

[52] U.S. Cl. ..... 2/425; 2/422

[58] Field of Search ..... 2/410, 411, 422, 2/424, 425, 5, 468, 68

[56] References Cited

U.S. PATENT DOCUMENTS

| | | | |
|---|---|---|---|
| 1,714,275 | 5/1929 | Mullins | 2/425 |
| 3,030,627 | 4/1962 | Rehman et al. . | |
| 3,174,155 | 3/1965 | Pitman | 2/411 |
| 3,900,896 | 8/1975 | Ackerman . | |
| 4,272,853 | 6/1981 | Schuessler | 2/424 |
| 5,123,408 | 6/1992 | Gaines . | |
| 5,261,125 | 11/1993 | Cartwright et al. . | |
| 5,508,900 | 4/1996 | Norman | 362/106 |
| 5,517,699 | 5/1996 | Abraham, II . | |
| 5,546,609 | 8/1996 | Rush, III . | |
| 5,553,330 | 9/1996 | Carveth . | |
| 5,581,818 | 12/1996 | Lorenzi et al. . | |

FOREIGN PATENT DOCUMENTS

| | | | |
|---|---|---|---|
| 252924 | 6/1926 | United Kingdom | 2/5 |

*Primary Examiner*—Michael A. Neas

*Attorney, Agent, or Firm*—John J. Welch, Jr., Esq.

[57] ABSTRACT

A sports helmet with a protective fincap made up of a sturdy, flexible material and affixed thereto centrally upon the top surface of the helmet such that the fincap extends centrally, upon the helmet, anterioposteriorally from the bottom edge of the frontal brim of the helmet to the backside occipital edge of the helmet. The fincap has minimum breadth and minimum height at the loci of the bottom edge of the frontal brim and the backside occipital edge respectively with breadth and height increasing anteroposteriorly and posteroanteriorly at the same rate to a point of maximum breadth and height at the locus of the intersection of a horizontally inclined line tangent to the uppermost portion of the topside surface of the helmet and positioned perpendicular to the vertically inclined and anteroposteriorally inclined horizontal central axes of symmetry of the helmet. The fincap is coextensive with a centrally positioned fin element made up of the same sturdy, flexible material as the fincap with the fin element being characterized by the presence of a top edge extending from the locus of the bottom edge of the frontal brim of the helmet to the locus of the backside occipital edge of the helmet.

4 Claims, 7 Drawing Sheets

SPORTS HELMET WITH PROTECTIVE FINCAP

B. PRIOR, PARENT OR RELATED APPLICATIONS

Figure 1:
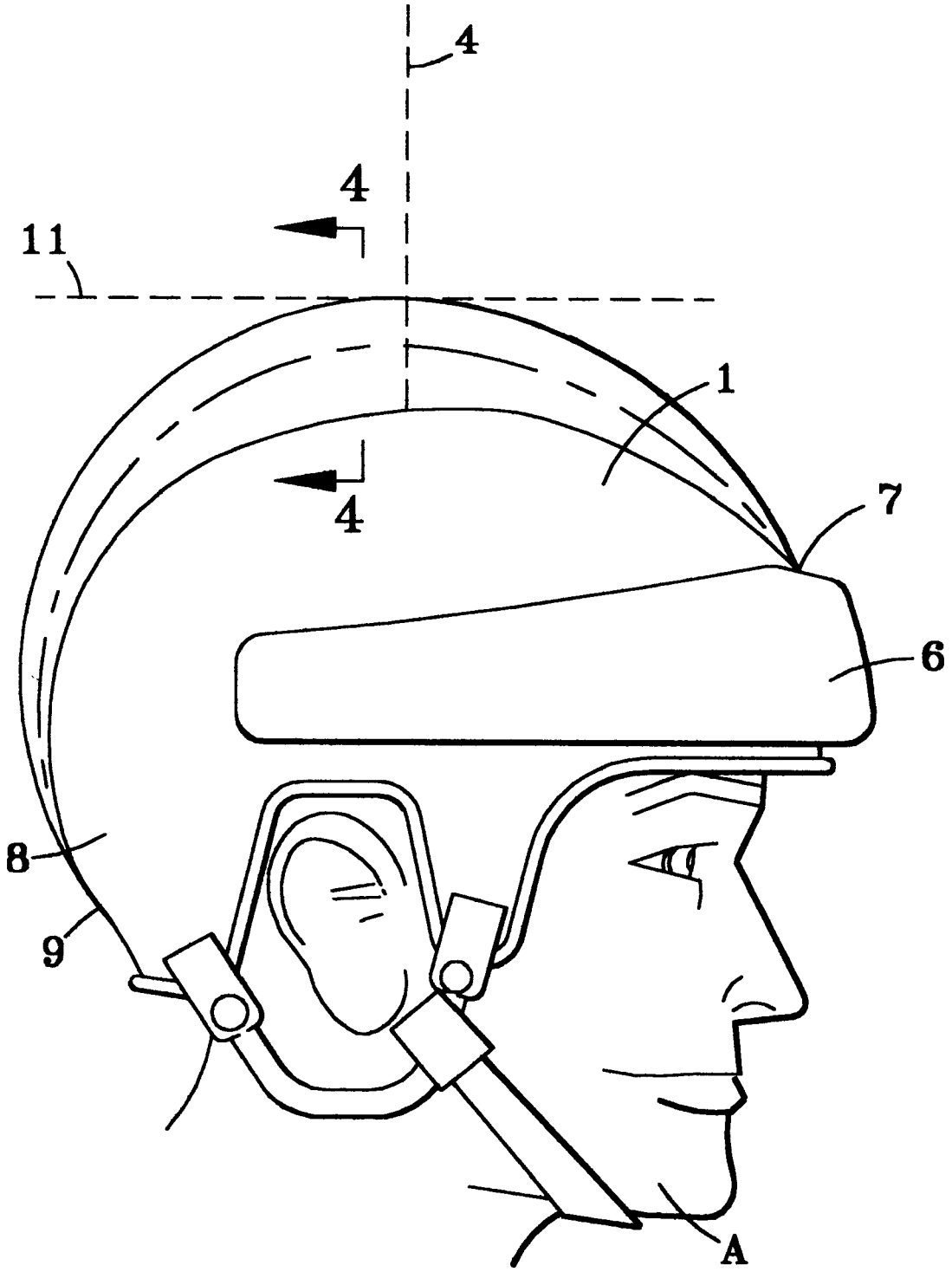

There are no prior, parent or related applications in respect of the instant invention.

C. FEDERALLY SPONSORED RESEARCH AND DEVELOPMENT

There is no federally sponsored research and development in respect of the instant invention.

D. BACKGROUND OF THE INVENTION

1. Field of the Invention

The instant invention relates to helmets worn by persons engaged in athletic endeavors.

2. Related Art

The references set forth in the enclosed "Art Statement" depict devices which however do not anticipate the instant invention.

E. A SUMMARY OF THE INVENTION

1. A Brief Description of the Invention

The instant invention consists of a conventional sports helmet to the exterior topside to which there has been anteroposteriorly affixed a centrally positioned fincap. The fincap anteroposteriorly extends from the locus of the bottom edge of a brim of the helmet in the front of the helmet all the way back to the bottom occipital edge of the back of the helmet. The height of a centrally positioned fin element of the fincap increases from its lowest measure, a minimum at the bottom edge of the frontal brim of the helmet to a maximum at the location of the vertical central axis of symmetry of the helmet then gradually decreases to an equivalent minimum once again at the locus of the bottom occipital edge of the back of the helmet. The fincap also has side to side breadth. Its breath is at a minimum at the bottom edge of the frontal brim of the helmet, then gradually increases to a maximum at the point where a horizontal line tangent to the apex of the helmet perpendicularly intersects the vertical central axis of symmetry of the helmet only to again decrease to an equivalent minimum at the location of the bottom occipital edge of the back of the helmet.

The whole of the fincap including its fin element is made of a sturdy, somewhat flexible material such as a polyurethane type of material, flexible, yet rigid enough to induce deflection of the helmet to which it is affixed, in the face of direct and instantaneous application of a strong force to the top edge of the fin element.

2. Objects of the Invention

Helmet devices have been in use by various sports participants in various athletic activities such as hockey, football, and lacrosse for many years. Such devices have been so in use in recognition of the fact that they can help prevent and/or mute somewhat head injuries to such participants. But, by and large such devices do not serve very well to prevent such participants from suffering spinal injuries, especially those injuries resulting from a direct impact to the top side of the head. Such injuries to spinal vertebrae resulting from so-called axial loading, namely, a transmittal of vectored force straight down the spinal column resulting from a blunt impact to the top of the head when the head is positioned in a straight line with the neck when the top of the head hits a wall with force such as, for example, can readily happen to a hockey player speeding about ice on skates, once checked by an opponent, can be especially devastating, and; as is oftentimes the case, regardless of whether such a hockey player suffering such an impact may then be helmeted. The types of such injuries that sometimes, once would be too much, befall helmeted hockey players are so-called "burst fractures" more often than not of the fifth or sixth cervical vertebrae. The power and focus of an impact force directed down the spinal column of a hockey player in such an instance is such that it causes significant destruction of a fourth and/or fifth vertebrae that in turn causes bruising and/or laceration of the spinal cord at the site of the fracture. Such bruising or laceration oftentime leads to the horror and heartbreak of virtually total paralysis of the body below the level of the fracture that lasts for a lifetime.

The instant invention constitutes a response to this problem that is at once simple and yet highly effective. The combination of a fincap and sports helmet operates to cause a deflection of the helmeted head to the side upon impact of the force to be felt from such impact in the manner just described. The result of such deflection is the transmittal down the spinal column of only a component of the force which will far more often than not, not be magnitude-wise sufficient enough to cause a burst fracture of a cervical vertebrae thereby essentially obviating the risk of significant paralysis for persons engaged in the playing of competitive hockey.

For the foregoing reason, respectfully submitted, the instant invention is not only new and unique but is unquestionably useful.

F. A DESCRIPTION OF THE DRAWINGS

1. FIG. 1 is a lateral plan view of the instant invention being worn by a person.

Figure 2:
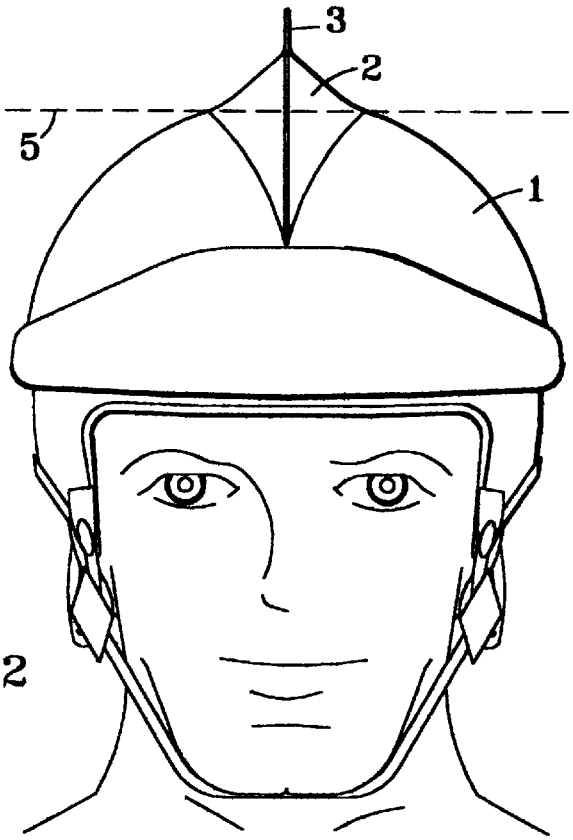

2. FIG. 2 is a frontal plan view of the instant invention being worn by a person.

Figure 3:
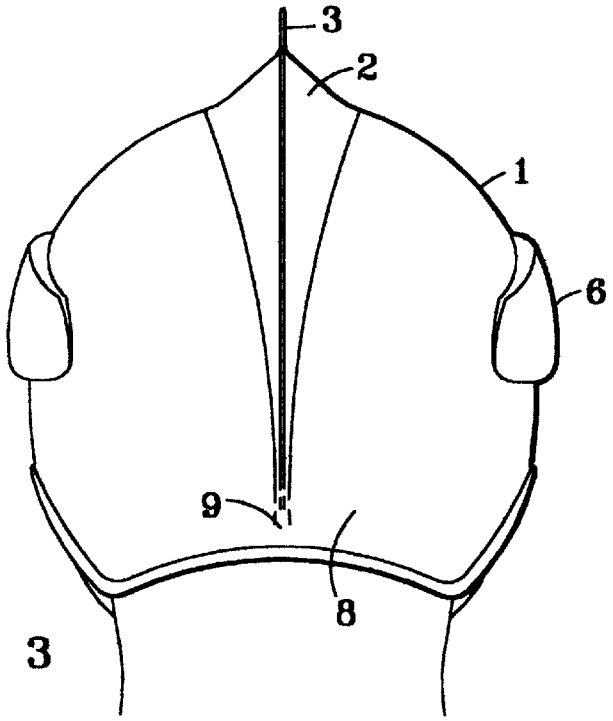

3. FIG. 3 is a rear plan view of the instant invention being worn by a person.

Figure 4:
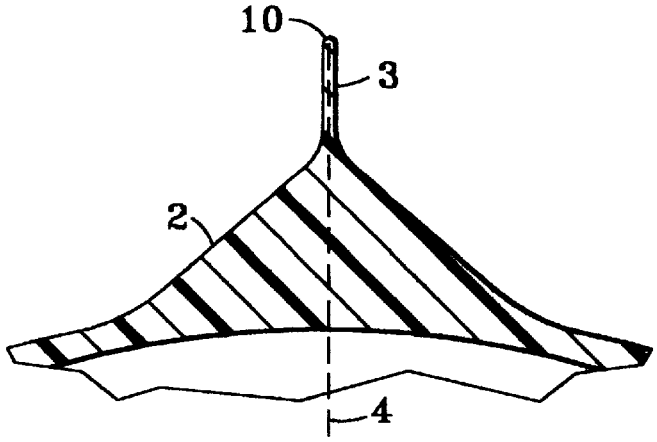

4. FIG. 4 is an isolated cut cross sectional view of the fincap component of the instant invention.

Figure 5:
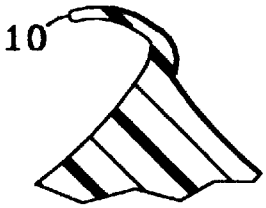

5. FIG. 5 is an isolated sagitally cut cross sectional view of the apex of the fincap component bent one way in the face of impact.

Figure 5A:
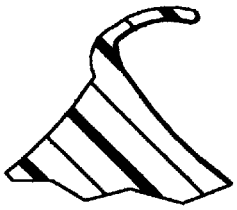

5A. FIG. 5A is an isolated sagitally cut cross sectional view of the apex of the fincap component bent another way in the face of impact.

Figure 6:
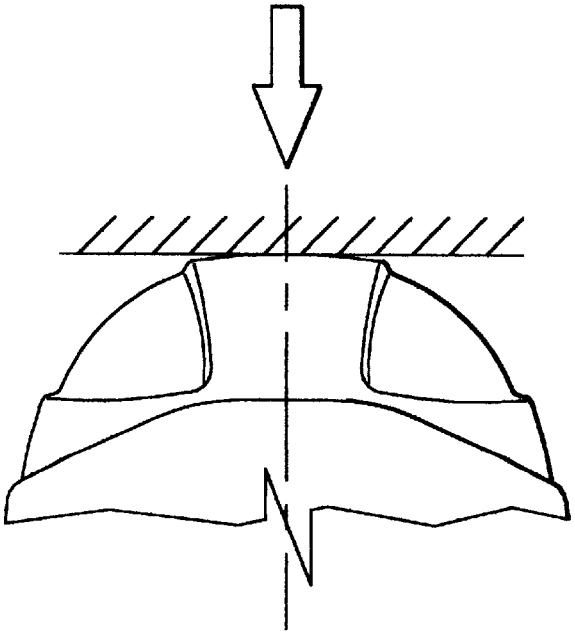
FIG. 6 PRIOR ART

6. FIG. 6 is a plan view of a conventional hockey helmet hitting a wall and the transmission of force directly down the spine.

Figure 7:
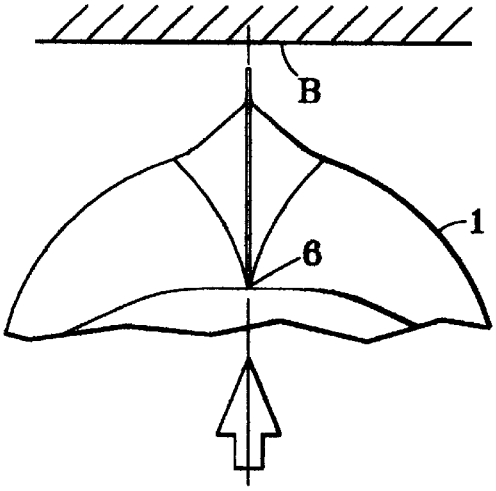

7. FIG. 7 is an isolated frontal plan view of the fincap component at the instant of impacting a wall.

Figure 8:
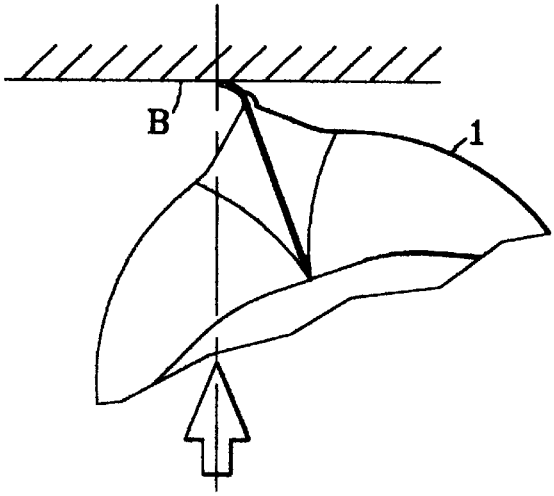

8. FIG. 8 is an isolated rear plan view of the instant invention illustrating how a bent fincap at just beyond the instant of impacting a wall deflects the helmeted head of a user one way.

Figure 9:
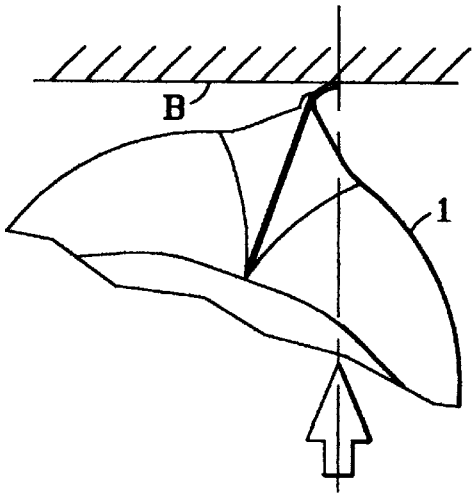

9. FIG. 9 is an isolated rear plan view of the instant invention illustrating how a bent fincap at just beyond the instant of impacting a wall deflects the helmeted head of a user another way.

Figure 10:
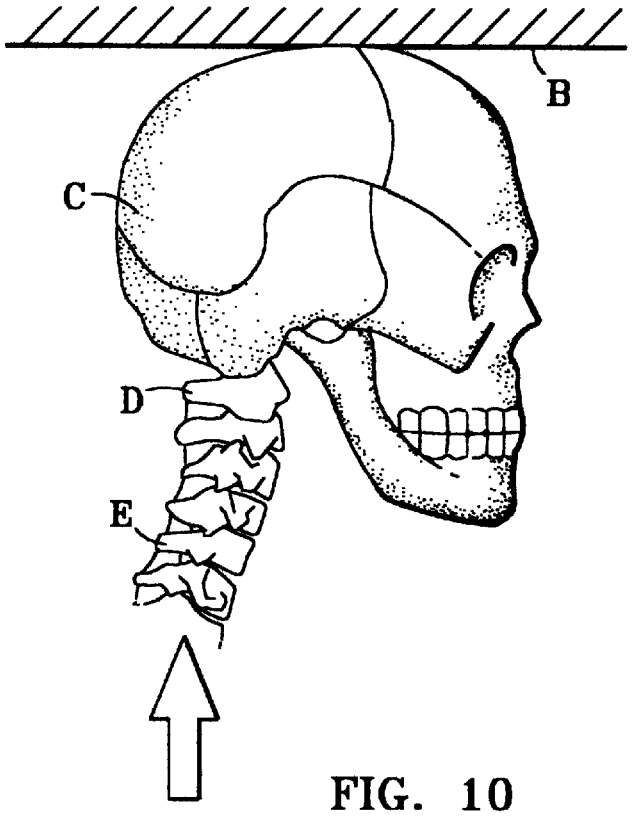

10. FIG. 10 is a lateral plan view of the bones of the head and neck and the transmission of force directly down the spine upon impact of the top of the head with a wall.

Figure 11:
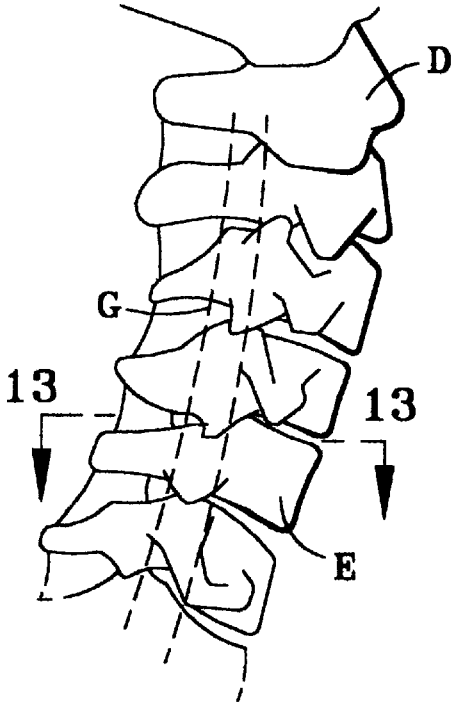

11. FIG. 11 is a close up, isolated, lateral plan view of the bones of the neck and spinal cord contained therein.

Figure 12:
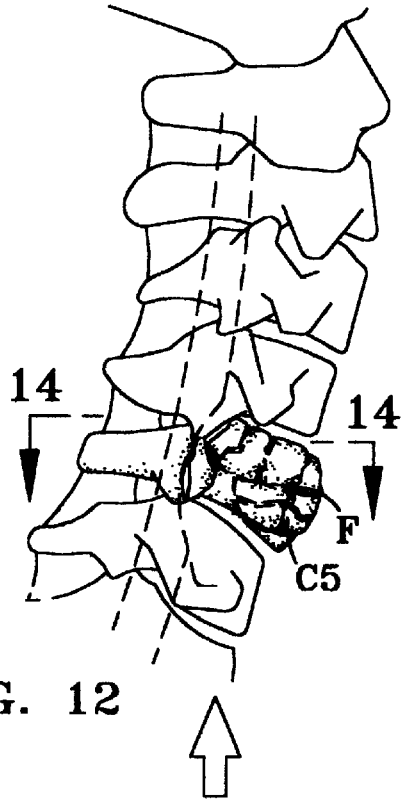

12. FIG. 12 is a close up, isolated, lateral plan view of a burst fracture at C-5 by virtue of an impact as depicted in FIG. 10.

Figure 13:
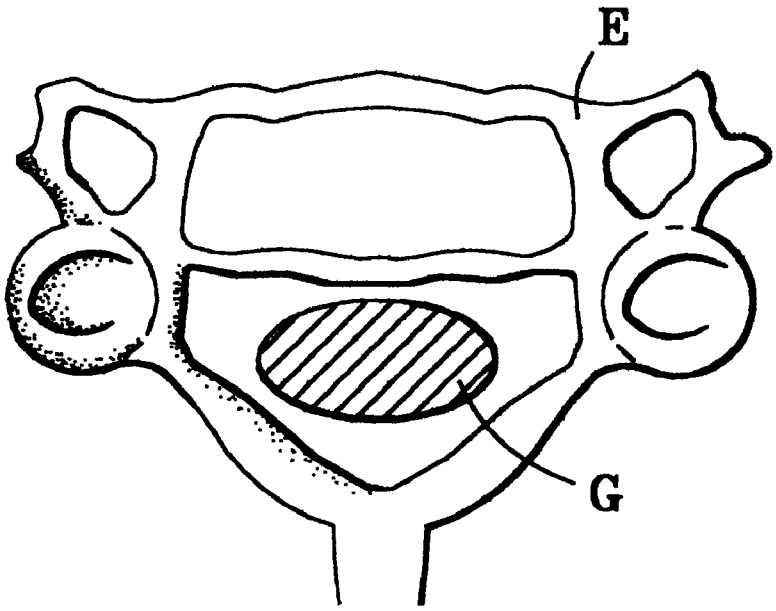

13. FIG. 13 is a top plan view of a human spinal column at the level of C-5 and the spinal cord therein encased.

Figure 14:
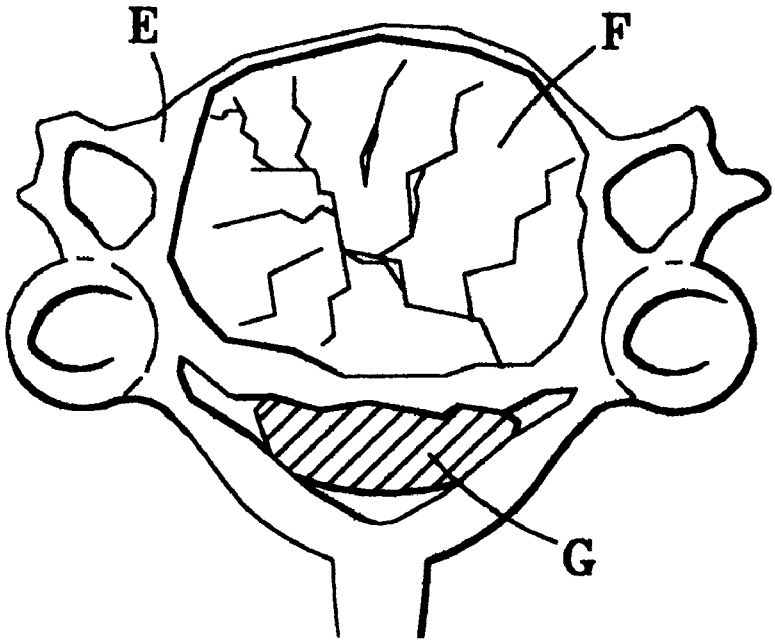

14. FIG. 14 is a top plan view of a burst fracture damage to the spinal cord at the level of C-5.

Figure 15:
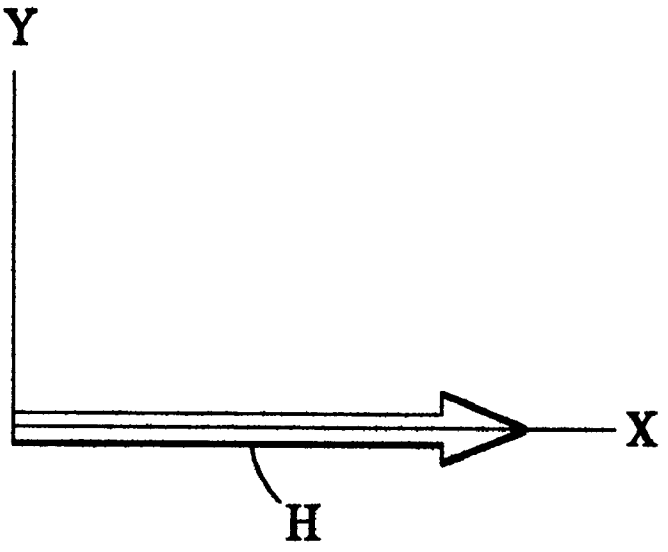

15. FIG. 15 is a schematic force diagram.

Figure 16:
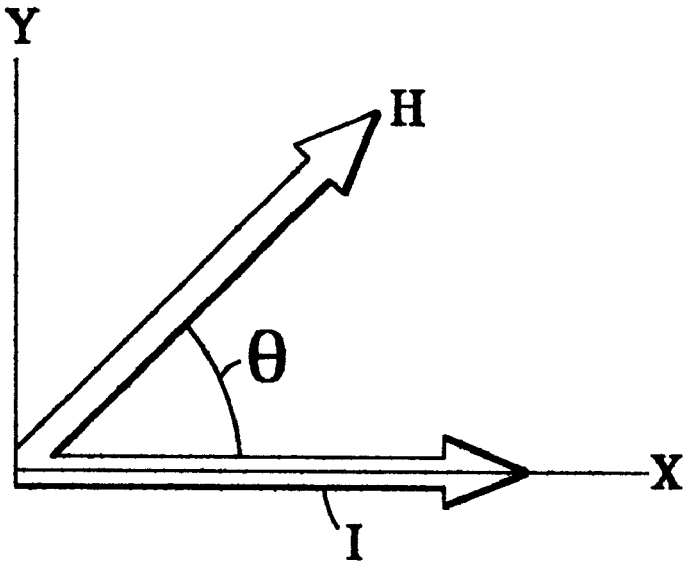

16. FIG. 16 is a second schematic force diagram.

G. A DESCRIPTION OF THE PREFERRED EMBODIMENT

The instant invention as depicted in FIGS. 1, 2 and 3 is a combination of a sports helmet component 1 equipped with a protective fincap component 2 permanently affixed thereon. It has long been understood that participants in certain contact sports activities such as football, lacrosse or ice hockey are at not insignificant risk of suffering serious spinal cord injuries albeit helmeted under circumstances wherein the tops of their helmeted heads make direct so-called axial loaded contact with another helmet worn by another participant or with perhaps an immovable wall or fixed structure. A typical helmet such as is now worn by, for example, hockey players serving to hopefully protect them from suffering erstwhile head injuries is depicted in FIG. 6. But, such a helmet is of virtually no value insofar as the matter of protecting such players from spinal cord injuries within a framework of a dynamic axial loading setting. Within such a setting, the force of such an impact is vectorially transferred from the point of contact between the very top of a participant A's helmeted head straight down the spine of such a person. The bones C and D of the head and neck of participant A are seen coming into direct impact with a wall B in FIG. 10. The arrow shown in FIG. 10 represents the reaction equal and opposite in magnitude and direction within the bone structure of participant A to the force of direct impact of the top of participant A's helmeted head with a wall B during, for example, the process of speedily skating after a moving puck while participating in a game of competitive ice hockey. FIG. 11, an isolated view of the bones of the neck D shows in particular, the fifth cervical vertebrae E also known simply as C-5. Under the force of such an axial loaded impact as described above, it has been noted that the commonest situs of failure of the bones of the neck D to withstand such a force is at the level of C-4 to C-5. It is at this locus that vertebral shattering in response to such a force is noted to most commonly occur. Such shattering also termed a burst fracture event is depicted in FIG. 12 wherein burst fracture F at the level of C-5 is illustrated as being deemed to have occurred at the instant of axial loaded impact of the top of speedily skating participant A's helmeted head with the rinkside surface of an immovable wall B. FIG. 13 serves to illustrate cross-sectionally the anatomical interrelationship of a cervical vertebrae, for example, fifth cervical vertebrae E and spinal cord G housed therein. In the event of a burst fracture F as described above and as is also depicted in FIG. 14, the spinal cord G of a participant A is seen to undergo damage in the face of such bony load bearing failure. Such spinal cord damage can result in an extremely tragic outcome for the hockey player. Such damage can run the gamut from transitory superficial bruising and/or localized swelling of spinal cord G at the locus of a fracture F resulting in short term motor and/or sensory neurological deficits being experienced by the player to marked bruising and/or indeed perhaps even focalized cord lacerations resulting in long term usually permanent neurological deficits ranging from partial paralysis coupled with localized losses of feeling to massive quadriplegia and sensory loss.

The instant invention serves to markedly and in a highly meaningful way, respond to the unhappy fact of an axial loaded C-5 burst fracture injury to sports participant's relatively fragile and highly vulnerable spinal cord G. The objective underlying the raison d' etre of the instant invention is to bring about a significant reduction in the magnitude of the force transferred down the spine of a sports participant undergoing the untoward experience of dynamic axial loading. If the magnitude of such a force is reduced to a level less than a magnitude sufficient to initiate a burst fracture F. At the level of C-4 or C-5, then, spinal cord injuries, at the level of C-4 or C-5, traditionally the weakest point of the bony structure of the neck whereat such fractures under such circumstances occur, could be avoided altogether or, at the very least, considerably minimized in terms of severity or rate of occurrence. Such a reduction in magnitude is brought about by virtue of the accommodation on the part of the instant invention to the principle that instantaneous deflection of a force from its path of travel off at an angle from that path of travel will result in that path of travel being occupied by merely a component only of that force. FIG. 15 schematically depicts a force H shown traveling along a horizontal line x in an xy plane. If that force H is instantaneously deflected from that line of travel x to a new line of travel xy through some angle theta removed from that line x, then as depicted schematically in FIG. 16, the force traversing line x at that instant will instantaneously become a force I with a magnitude equal to that of force H multiplied by the sine value of theta which new magnitude will be significantly less than the magnitude of H and less than the value needed to generate an intra-anatomical reactive force sufficient to initiate a burst fracture F. It is understood that such deflection in the real word occurs in so-called three-space, not two-space as depicted in FIGS. 15 and 16 and that as such one would note deflection and resultant x, y and z components, however, the principle sought to be articulated is as readily demonstrable with resort to two-space as with respect to three-space while at the same time being inherently easier to briefly describe. The instant invention serves to reduce the magnitude of a force H generated at the very instant of dynamic axial loading down to the level of that of a force I and, in so doing, operates to concomitantly abrogate or at the very least minimize the frequency of occurrence as well as the intensity of burst fractures F at the level of C4 or C-5 within the persons of hockey participants A. FIG. 4 depicts cross-sectionally fincap component 2 and fin element 3 at the locus of the vertically inclined central axis of symmetry 4 of the instant invention. Fincap component 2 as can be noted with resort to FIG. 2 is anteroposteriorly affixed to the exterior topside surface of sports helmet component 1 and is centered upon the anteroposterior centerline of sports helmet component 1. As can further be noted with resort to a viewing of FIGS. 1, 2 and 3, fincap component 2 has anteroposterior length equal to a centerline distance extending from a bottom edge 7 of a frontal brim 6 of sports helmet component 1 to a backside occipital edge 9 of the backside 8 of sports helmet component 1. As can be further noted with resort to a viewing of FIGS. 1, 2 and 3, fincap component 2 has a frontside minimum side to side breadth and a frontside minimum height at the locus of bottom edge 7 and a backside minimum side to side breadth and backside minimum height at the locus of backside occipital edge 9. The backside minimum height is equal to the frontside minimum height. The backside minimum side to side breadth is equal to the frontside minimum side to side breadth. The frontside minimum height and side to side breadth increases as do the backside minimum height and side to side breadth to respective maximums of each upon the exterior topside of sports helmet component 1 at a locus thereupon as would be marked by the presence of a horizontally inclined tangent line 5 tangent to the uppermost portion of the exterior topside of sports helmet component 1 and perpendicular to and intersecting not only the vertically inclined central axis of symmetry 4 of sports helmet component 1 but also the horizontally inclined anteroposterior central axis of symmetry 11 of sports helmet component 1. The heights made mention above are the heights of fin element 3, the exterior surface of which is everywhere coextensive with the exterior surface of fincap component 2, fin element 3 being a centrally positioned portion of fincap component 2. The anteroposterior lengths of fincap component 2 and fincap element 3 are equivalent to one another. A top edge 10 of fin element 3 extends continuously from the bottom edge 7 of frontal brim 6 to backside occipital edge 9 of backside 8. Fincap component 2 and fin element 3 thereof are made of the same sturdy flexible material. Such material is typically a polyurethane material characterized by ultrahigh abrasion resistance, toughness and ultrahigh resistance to cutting and tearing as well as being somewhat flexible under the influence of a reasonably high amount of pressure as, for example, pressure resultant from the application of an axial loading force to edge 10 of fin element 3 of the order of the force as would be instantaneously generated in response to the impacting of an inflexible wall B by a 200 to 220 pound man skating at 30 to 35 miles per hour on ice. FIGS. 5 and 8 and FIGS. 5A and 9 serve to illustrate what occurs at the instant of impact of top edge 10 of fin element 3 with a wall B as seen in FIG. 7 when fin element 3 coextensive with fincap component 2 affixed to sports helmet component 1 being the instant invention as described above is worn by a person A within the framework of such a setting and characterized moreover by axial loading. A force H applied to top edge 10, sufficient to cause a burst fracture at the level of C-5, is instantaneously deflected either to the left or to the right as depicted in FIGS. 5 and 8 and FIGS. 5A and 9 by virtue of the instantaneous bending of sturdy, flexible fin element 3 at the very instant of impact. It is precisely on account of such bending that force H is deflected and instead of force F being transmitted down the spinal column of person A in such a setting, a lesser force, namely a force equal in magnitude to only the magnitude of force H multiplied by the sine value of the angle of deflection of force H occasioned by such bending, is the force transmitted down the spinal column of person A. And, this lesser force will not be sufficient in magnitude to induce a burst fracture a the level of C-4 or C-5. A hardy rubber material or thermoplastic material with flexibility at temperatures between −5 degrees centigrade and 20 degrees centigrade, the typical temperature range variation between the temperature on ice within a small town outdoor hockey rink and the temperature on ice within a modern indoor sports hockey arena are other types of material that would suffice for the above described purposes as well.

As will be noted from the foregoing, the instant invention will serve to essentially foreclose the possibility of tragically paralytic injuries occurring as would thereby severely compromise the quality of life of competitive sports participants. It is for this reason that the instant invention is, respectfully submitted not only new and unique but unquestionably useful.

What is claimed is:

1. A Sports Helmet With Protective Fincap, comprising:

a. a sports helmet component;

b. a fincap component;

c. said fincap component being anteroposteriorly affixed to an exterior topside of said sports helmet component and centered upon an anteroposterior centerline of said sports helmet component;

d. said fincap component having anteroposterior length equal to a centerline distance extending from a bottom edge of a frontal brim of said sports helmet component to a backside occipital edge of a backside of said sports helmet component;

e. said fincap component having a frontside minimum side to side breadth at a locus of said bottom edge of said frontal brim and a backside minimum side to side breadth at a locus of said backside occipital edge of said backside;

f. said frontside minimum side to side breadth being equal in breadth to said backside minimum of side to side breadth;

g. said frontside minimum side to side breadth increasing to a maximum side to side breadth from said locus of said bottom edge of said frontal brim to a locus upon said exterior topside equivalent to a locus of a horizontally inclined line tangent to an uppermost portion of said exterior topside and perpendicular to and intersecting both a vertically inclined central axis of symmetry of said sports helmet component and a horizontally inclined anteroposterior central axis of symmetry of said sports helmet component;

h. said backside minimum side to side breadth increasing to a maximum side to side breadth from said locus of said bottom occipital edge of said backside to said locus upon said exterior topside equivalent to said locus of said horizontally inclined line tangent to said uppermost portion of said exterior topside and perpendicular to and intersecting said vertically inclined central axis of symmetry of said sports helmet component and said horizontally inclined anterorposterior central axis of symmetry of said sports helmet component;

i. said fincap component being characterized by the presence of an anteroposteriorly centrally positioned fin element, an exterior surface of which said fin element is coextensive with an exterior surface of said fincap component;

j. said fin element having anteroposterior length equal to said anteroposterior length of said fincap component;

k. said fincap component having maximum height everywhere equal to a height of said fin element;

l. said height of said fin element having a frontside minimum height at said locus of said bottom edge of said frontal brim and a backside minimum height at said locus of said backside occipital edge of said backside;

m. said frontside minimum height being equal in height to said backside minimum height;

n. said frontside minimum height increasing to a maximum height from said locus of said bottom edge of said frontal brim to said locus upon said exterior topside equivalent to said locus of said horizontally inclined line tangent to said uppermost portion of said exterior topside and perpendicular to and intersecting both said vertically inclined axis of symmetry of said sports helmet component and said horizontally inclined anteroposterior central axis of symmetry of said sports helmet component;

o. said backside minimum height increasing to said maximum height from said locus of said backside occipital edge to said locus upon said exterior topside equivalent to said locus of said horizontally inclined line tangent to said uppermost portion of the exterior topside and perpendicular to and intersecting both said vertically inclined axis of symmetry of said sports helmet component and said horizontally inclined anteroposterior central axis of symmetry of said sports helmet component;

p. said fin element having a continuous top edge extending anteroposteriorly from said locus of said bottom edge of said frontal brim to said locus of said backside occipital edge of said backside, and;

q. said fincap component and said fin element being made of the same sturdy flexible material.

2. The sports helmet with protective fincap of claim 1, whereby said sturdy, flexible material is a polyurethane material.

3. The sports helmet with protective fincap of claim 1, whereby said sturdy, flexible material is a hard rubber material.

4. The sports helmet with protective fincap of claim 1, whereby said sturdy, flexible material is a thermoplastic material flexible at temperatures within the range of −5° C. to 25° C.

* * * * *